US012331970B2

(12) United States Patent
Qiu et al.

(10) Patent No.: US 12,331,970 B2
(45) Date of Patent: Jun. 17, 2025

(54) HEAT PUMP SYSTEM

(71) Applicants: York Guangzhou Air Conditioning and Refrigeration Co., Ltd., Qingyuan (CN); Johnson Controls Tyco IP Holdings LLP, Milwaukee, WI (US)

(72) Inventors: Xiening Qiu, Qingyuan (CN); Tianlong Xiao, Qingyuan (CN); Lue Lv, Qingyuan (CN); Xiaoyan Zhang, Qingyuan (CN); Jingjing Xu, Qingyuan (CN)

(73) Assignees: TYCO FIRE & SECURITY GMBH, Neuhausen am Rheinfall (CH); York Guangzhou Air Conditioning and Refrigeration Co., Ltd., Qingyuan (CN)

( * ) Notice: Subject to any disclaimer, the term of this patent is extended or adjusted under 35 U.S.C. 154(b) by 213 days.

(21) Appl. No.: 18/016,016

(22) PCT Filed: Jul. 16, 2021

(86) PCT No.: PCT/CN2021/106901
§ 371 (c)(1),
(2) Date: Jan. 13, 2023

(87) PCT Pub. No.: WO2022/017297
PCT Pub. Date: Jan. 27, 2022

(65) Prior Publication Data

US 2023/0213249 A1 Jul. 6, 2023

(30) Foreign Application Priority Data

Jul. 24, 2020 (CN) ..... 202010722347.2

(51) Int. Cl.
*F25B 13/00* (2006.01)
*F25B 41/20* (2021.01)

(52) U.S. Cl.
CPC ..... *F25B 41/20* (2021.01); *F25B 13/00* (2013.01); *F25B 2313/0276* (2013.01); *F25B 2600/25* (2013.01)

(58) Field of Classification Search
CPC .. F25B 13/00; F25B 41/20; F25B 2313/0276; F25B 2600/25
See application file for complete search history.

(56) References Cited

U.S. PATENT DOCUMENTS 5,092,134 A 3/1992 Tagashira et al.
5,634,352 A 6/1997 Nagai et al.
(Continued)

FOREIGN PATENT DOCUMENTS

CN 203823897 U 9/2014
CN 104374115 A 2/2015
(Continued)

OTHER PUBLICATIONS

Extended European Search Report for EP Application No. 21847138.1, dated Mar. 19, 2024, 7 pages.
(Continued)

*Primary Examiner* — Jonathan Bradford
(74) *Attorney, Agent, or Firm* — Fletcher Yoder, P.C.

(57) ABSTRACT

A heat pump system is provided. The heat pump system comprises a compressor, a first heat exchanger, a second heat exchanger, a third heat exchanger and a six-way valve. The compressor comprises a fluid suction port and a fluid discharge port. The first heat exchanger is arranged in a first circulation path, the second heat exchanger is arranged in a second circulation path, and the third heat exchanger is arranged in a third circulation path, wherein the first circulation path, the second circulation path and the third circulation path are parallel paths. A first end of the first circulation path, a first end of the second circulation path and a first end of the third circulation path are connected to the six-way valve and are in controllable communication with the fluid suction port and the fluid discharge port of the compressor by means of the six-way valve. A second end of the first circulation path, a second end of the second circulation path and a second end of the third circulation path are connected to a common path converging point. The components of the heat pump system in the present application
(Continued)

have simple pipelines, have a high degree of integration, are not difficult to mount, and have a small pressure drop during fluid suction and discharge, and the control logic therefor is simple.

11 Claims, 9 Drawing Sheets

(56) References Cited

U.S. PATENT DOCUMENTS

| | | | |
|---|---|---|---|
| 2009/0049857 | A1 | 2/2009 | Murakami et al. |
| 2019/0203981 | A1 | 7/2019 | Akaiwa et al. |
| 2020/0158390 | A1 | 5/2020 | Shen et al. |

FOREIGN PATENT DOCUMENTS

| | | | |
|---|---|---|---|
| CN | 108870803 | A | 11/2018 |
| CN | 109595846 | A | 4/2019 |
| CN | 110530074 | A | 12/2019 |
| CN | 209800783 | U | 12/2019 |
| CN | 110762888 | A | 2/2020 |
| EP | 3379176 | A1 | 9/2018 |
| JP | 2011202738 | A | 10/2011 |
| JP | 2017150645 | A | 8/2017 |

OTHER PUBLICATIONS

PCT International Search Report for PCT Application No. PCT/CN2021/106901, mailed Jan. 27, 2022, 3 pgs.

HEAT PUMP SYSTEM

CROSS-REFERENCE TO RELATED APPLICATIONS

This application is a U.S. National Stage Application of PCT Application No. PCT/CN2021/106901, entitled "HEAT PUMP SYSTEM," filed Jul. 16, 2021, which claims priority to and the benefit of Chinese Patent Application No. 202010722347.2, filed Jul. 24, 2020, each of which is herein incorporated by reference in its entirety for all purposes.

BACKGROUND

Technical Field

This application relates to the field of air conditioners, and in particular, to a heat pump system.

Related Art

A heat pump system includes a compressor, two heat exchangers, a throttle device, and a four-way valve, which can provide an air conditioner cooling capacity and an air conditioner heating capacity to the outside world. However, the heat pump system has few operating modes. Therefore, a heat pump system which supports a plurality of operating modes such as providing an air conditioner cooling capacity to the outside world, providing an air conditioner heating capacity to the outside world, providing a hot water heating capacity to the outside world, and providing a hot water heating capacity to the outside world while providing an air conditioner cooling capacity to the outside world.

SUMMARY

In order to achieve the foregoing objective, this application provides a heat pump system. The heat pump system includes a compressor, a first heat exchanger, a second heat exchanger, a third heat exchanger, and a six-way valve. The compressor includes a fluid suction port and a fluid discharge port. The first heat exchanger is arranged in a first circulation path, the second heat exchanger is arranged in a second circulation path, and the third heat exchanger is arranged in a third circulation path. The first circulation path, the second circulation path, and the third circulation path are parallel paths, a first end of the first circulation path, a first end of the second circulation path, and a first end of the third circulation path are connected to the six-way valve, and are in controllable communication with the fluid suction port and the fluid discharge port of the compressor through the six-way valve. A second end of the first circulation path, a second end of the second circulation path, and a second end of the third circulation path are connected to a common path converging point.

According to the heat pump system, the six-way valve includes six ports, one of the six ports is in communication with the fluid discharge port of the compressor, two of the six ports are in communication with the fluid suction port of the compressor, and remaining three ports are respectively in communication with the first end of the first circulation path, the first end of the second circulation path, and the first end of the third circulation path.

According to the heat pump system, the six-way valve includes a first port, a second port, a third port, a fourth port, a fifth port, and a sixth port, where the first port is connected to the fluid discharge port of the compressor, the second port is connected to the first end of the third circulation path, the third port is connected to the fluid suction port of the compressor, the fourth port is connected to the first end of the second circulation path, the fifth port is connected to the fluid suction port of the compressor, and the sixth port is connected to the first end of the first circulation path. The six-way valve has a first state, a second state, and a third state, and the six-way valve is configured such that when the six-way valve is in the first state, the first port is in communication with the second port, the third port is in communication with the sixth port, and the fourth port is in communication with the fifth port; when the six-way valve is in the second state, the second port is in communication with the third port, the first port is in communication with the fourth port, and the fifth port is in communication with the sixth port; and when the six-way valve is in the third state, the third port is in communication with the fourth port, the second port is in communication with the fifth port, and the first port is in communication with the sixth port.

According to the heat pump system, the heat pump system further includes a first throttle device, a second throttle device, a third throttle device. The first throttle device is arranged in the first circulation path and includes a first throttle inlet and a first throttle outlet. The second throttle device is arranged in the second circulation path and includes a second throttle inlet and a second throttle outlet. The third throttle device is arranged in the third circulation path and includes a third throttle inlet and a third throttle outlet. The first throttle inlet, the second throttle inlet, and the third throttle inlet are connected to the path converging point.

According to the heat pump system, the heat pump system further includes a first bypass, a second bypass, a third bypass, and a first control valve, a second control valve, and a third control valve respectively arranged in the first bypass, the second bypass, and the third bypass. A first end of the first bypass is connected to the first throttle outlet, a first end of the second bypass is connected to the second throttle outlet, a first end of the third bypass is connected to the third throttle outlet, a second end of the first bypass, a second end of the second bypass, and a second end of the third bypass are connected to a common bypass converging point to respectively controllably bypass the first throttle device, the second throttle device, and the third throttle device, so that the first heat exchanger, the second heat exchanger, and the third heat exchanger are in fluid communication with the bypass converging point.

According to the heat pump system, the first control valve, the second control valve, and the third control valve are one-way valves. The first control valve is configured such that a fluid flows from the first heat exchanger to the bypass converging point through the first bypass, the second control valve is configured such that a fluid flows from the second heat exchanger to the bypass converging point through the second bypass, and the third control valve is configured such that a fluid flows from the third heat exchanger to the bypass converging point through the third bypass.

According to the heat pump system, the heat pump system is configured to implement a plurality of operating modes, and the plurality of operating modes include a separate cooling mode. When the heat pump system is in the separate cooling mode, the six-way valve is maintained in the first state, the third control valve and the second throttle device are turned on, and the first control valve, the second control valve, the first throttle device, and the third throttle device are turned off, so that the compressor, the third heat exchanger, the second throttle device, and the second heat exchanger are connected in a refrigerant loop.

According to the heat pump system, the heat pump system is configured to implement a plurality of operating modes, and the plurality of operating modes include a separate heating mode. When the heat pump system is in the separate heating mode, the six-way valve is maintained in the second state, the second control valve and the third throttle device are turned on, and the first control valve, the third control valve, the first throttle device, and the second throttle device are turned off, so that the compressor, the second heat exchanger, the third throttle device, and the third heat exchanger are connected in a refrigerant loop.

According to the heat pump system, the heat pump system is configured to implement a plurality of operating modes, and the plurality of operating modes include a separate hot water production mode. When the heat pump system is in the separate hot water production mode, the six-way valve is maintained in the third state, the first control valve and the third throttle device are turned on, and the second control valve, the third control valve, the first throttle device, and the second throttle device are turned off, so that the compressor, the first heat exchanger, the third throttle device, and the third heat exchanger are connected in a refrigerant loop.

According to the heat pump system, the heat pump system is configured to implement a plurality of operating modes, and the plurality of operating modes include a cooling and hot water production mode. When the heat pump system is in the cooling and hot water production mode, the six-way valve is maintained in the third state, the first control valve and the second throttle device are turned on, and the second control valve, the third control valve, the first throttle device, and the third throttle device are turned off, so that the compressor, the first heat exchanger, the second throttle device, and the second heat exchanger are connected in a refrigerant loop.

According to the heat pump system, the heat pump system is configured to implement a plurality of operating modes, and the plurality of operating modes include a hot water production and defrosting mode. When the heat pump system is in the hot water production and defrosting mode, the six-way valve is maintained in the first state, the third control valve and the first throttle device are turned on, and the first control valve, the third control valve, the second throttle device, and the third throttle device are turned off, so that the compressor, the third heat exchanger, the first throttle device, and the first heat exchanger are connected in a refrigerant loop.

The components of the heat pump system in this application have simple pipelines, have a high degree of integration, can be easily mounted, and have a small pressure drop during fluid suction and discharge, and the control logic therefore is simple.

Other features, advantages, and embodiments of the present application may be described or become apparent by considering the following specific implementations, drawings and claims. In addition, it should be understood that the above contents of the invention and the following specific implementations are exemplary and are intended to provide further explanation without limiting the scope of the application for which protection is claimed. However, the specific implementations and specific examples only indicate the preferred embodiments of this application. For those skilled in the art, various changes and modifications within the spirit and scope of this application will become apparent through the specific implementations.

BRIEF DESCRIPTION OF THE DRAWINGS

The features and advantages of this application can be better understood by reading the following detailed description with reference to the drawings. In the whole drawings, the same reference numerals represent the same components.

DETAILED DESCRIPTION

Various specific implementations of this application are described below with reference to the accompanying drawings constituting a part of this specification. It should be understood that ordinal numerals such as "first" and "second" used in this application are only used to distinguish and identify, and do not have any other meaning. If not specified, they do not represent a specific order or have a specific relevance. For example, the term "first heat exchanger" does not imply the existence of "second heat exchanger", nor does the term "second heat exchanger" imply the existence of "first heat exchanger".

Figure 1:
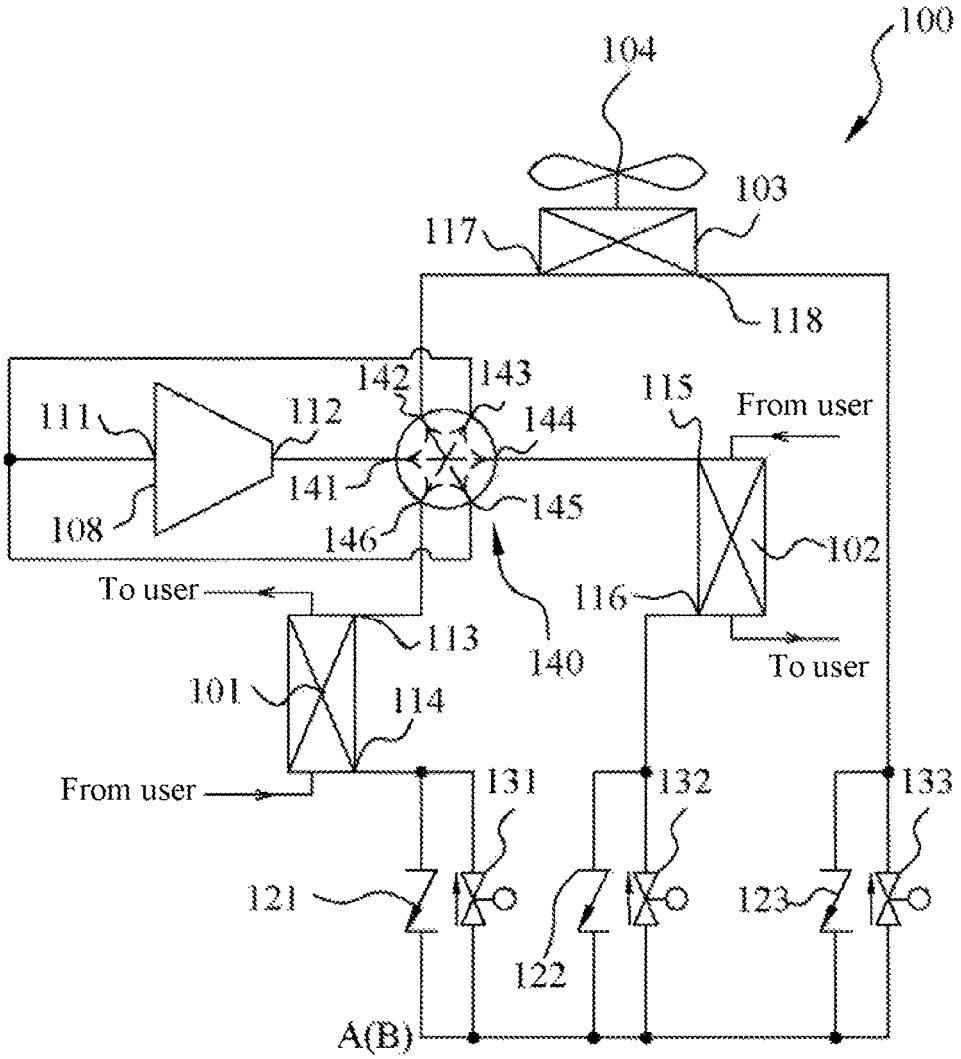
FIG. 1 is a system diagram of a heat pump system according to a first embodiment of this application.

FIG. 1 is a system diagram of a heat pump system 100 according to a first embodiment of this application, showing components of the heat pump system and connections thereof. As shown in FIG. 1, the heat pump system 100 includes a compressor 108, a first heat exchanger 101, a second heat exchanger 102, a third heat exchanger 103, a six-way valve 140, a first throttle device 131, a second throttle device 132, a third throttle device 133, and a plurality of other valves to be described below. Connecting lines between the plurality of components (including the compressor 108, the three heat exchangers, the six-way valve 140, the three throttle devices, and the other valves) shown in FIG. 1 represent connecting pipes.

The heat pump system 100 includes a first circulation path, a second circulation path, and a third circulation path. The first circulation path, the second circulation path, and the third circulation path are parallel paths. The first heat exchanger 101 and the first throttle device 131 are arranged in series in the first circulation path, the second heat exchanger 102 and the second throttle device 132 are arranged in series in the second circulation path, and the third heat exchanger 103 and the third throttle device 133 are arranged in series in the third circulation path. Specifically, a second circulation port 114 of the first heat exchanger 101 is connected to a first throttle outlet of the first throttle device 131, a second circulation port 116 of the second heat exchanger 102 is connected to a second throttle outlet of the second throttle device 132, and a second circulation port 118 of the third heat exchanger 103 is connected to a third throttle outlet of the third throttle device 133.

A first end of the first circulation path, a first end of the second circulation path, and a first end of the third circulation path are connected to the six-way valve 140. A second end of the first circulation path, a second end of the second circulation path, and a second end of the third circulation path are connected to a common path converging point A. Specifically, the six-way valve 140 includes a first port 141, a second port 142, a third port 143, a fourth port 144, a fifth port 145, and a sixth port 146. The first end of the first circulation path is connected to the sixth port 146, the first end of the second circulation path is connected to the fourth port 144, and the first end of the third circulation path is connected to the second port 142. That is to say, a first circulation port 113 of the first heat exchanger 101 is in communication with the sixth port 146, a first circulation port 115 of the second heat exchanger 102 is in communication with the fourth port 144, and a first circulation port 117 of the third heat exchanger 103 is in communication with the second port 142. A first throttle inlet of the first throttle device 131, a second throttle inlet of the second throttle device 132, and a third throttle inlet of the third throttle device 133 are in communication with the path converging point A. In an embodiment of this application, the first throttle device 131, the second throttle device 132, and the third throttle device 133 all may be controlled to be turned on or off.

The compressor 108 includes a fluid suction port 111 and a fluid discharge port 112. The fluid discharge port 112 is connected to the first port 141 of the six-way valve 140 through the connecting pipe, so that the fluid discharge port 112 is in communication with the first port 141 of the six-way valve 140. The fluid suction port 111 is connected to the third port 143 and the fifth port 145 of the six-way valve 140 through the connecting pipe, so that the fluid suction port 111 is in communication with the third port 143 and the fifth port 145 of the six-way valve 140.

The six-way valve 140 includes a first circulation channel 151, a second circulation channel 152, and a third circulation channel 153 (refer to FIG. 4 to FIG. 6), and has a first state, a second state, and a third state. The six-way valve 140 is configured such that when the six-way valve 140 is in the first state, the first port 141 is in fluid communication with the second port 142 through the first circulation channel 151, the third port 143 is in fluid communication with the sixth port 146 through the second circulation channel 152, and the fourth port 144 is in fluid communication with the fifth port 145 through the third circulation channel 153 (refer to FIG. 4); when the six-way valve 140 is in the second state, the second port 142 is in fluid communication with the third port 143 through the first circulation channel 151, the first port 141 is in fluid communication with the fourth port 144 through the second circulation channel 152, and the fifth port 145 is in fluid communication with the sixth port 146 through the third circulation channel 153 (refer to FIG. 5); and when the six-way valve 140 is in the third state, the third port 143 is in fluid communication with the fourth port 144 through the first circulation channel 151, the second port 142 is in fluid communication with the fifth port 145 through the second circulation channel 152, and the first port 141 is in fluid communication with the sixth port 146 through the third circulation channel 153 (refer to FIG. 6).

The heat pump system 100 further includes a first bypass, a second bypass, and a third bypass. A first end of the first bypass is connected between the second circulation port 114 of the first heat exchanger 101 and the first throttle outlet of the first throttle device 131, so that the first end of the first bypass is in communication with the second circulation port 114 of the first heat exchanger 101. A first end of the second bypass is connected between the second circulation port 116 of the second heat exchanger 102 and the second throttle outlet of the second throttle device 132, so that the first end of the second bypass is in communication with the second circulation port 116 of the second heat exchanger 102. A first end of the third bypass is connected between the second circulation port 118 of the third heat exchanger 103 and the third throttle outlet of the third throttle device 133, so that the first end of the third bypass is in communication with the second circulation port 118 of the third heat exchanger 103. The second end of the first bypass, the second end of the second bypass, and the second end of the third bypass are connected to a common bypass converging point B, so that the second circulation port 114 of the first heat exchanger 101, the second circulation port 116 of the second heat exchanger 102, and the second circulation port 118 of the third heat exchanger 103 may be connected to the bypass converging point B through the first bypass, the second bypass, and the third bypass respectively. In this embodiment, the path converging point A and the bypass converging point B are the same point.

The heat pump system 100 further includes a first control valve 121 arranged in the first bypass, a second control valve 122 arranged in the second bypass, and a third control valve 123 arranged in the third bypass, which are respectively configured to control connection and disconnection of the first bypass, the second bypass, and the third bypass. In this embodiment of this application, the first control valve 121, the second control valve 122, and the third control valve 123 are one-way valves. The first control valve 121 is configured such that a fluid (for example, a refrigerant) can flow from the second circulation port 114 of the first heat exchanger 101 to the bypass converging point B through the first bypass. The second control valve 122 is configured such that a fluid (for example, a refrigerant) to can flow from the second circulation port 116 of the second heat exchanger 102 to the bypass converging point B through the second bypass. The third control valve 123 is configured such that a fluid (for example, a refrigerant) can flow from the second circulation port 118 of the third heat exchanger 103 to the bypass converging point B through the third bypass.

However, those skilled in the art may understand that the first control valve 121, the second control valve 122, and the third control valve 123 may alternatively be configured as other types of valves, as long as an upstream and a downstream of a valve may be controlled to be communicated or disconnected.

In this embodiment of this application, the first heat exchanger 101 is a water side heat exchanger. As a condenser, the first heat exchanger may provide hot water for a user. The first heat exchanger may alternatively be used as an evaporator. The second heat exchanger 102 is an air side heat exchanger. The second heat exchanger may be used as a condenser/evaporator to provide a heating capacity/cooling capacity for the user. The third heat exchanger 103 is an air side heat exchanger. The third heat exchanger includes a fan 104.

The third heat exchanger may be used as a condenser/evaporator to provide a heating capacity/cooling capacity to the outside world.

Those skilled in the art may understand that the above first heat exchanger 101, second heat exchanger 102, and third heat exchanger 103 are merely illustrative, and in other examples, the first heat exchanger 101, the second heat exchanger 102, and the third heat exchanger 103 may be a heat exchanger in any form. For example, the third heat exchanger 103 may be a ground source heat exchanger, a water source heat exchanger, or the like.

Figure 2:
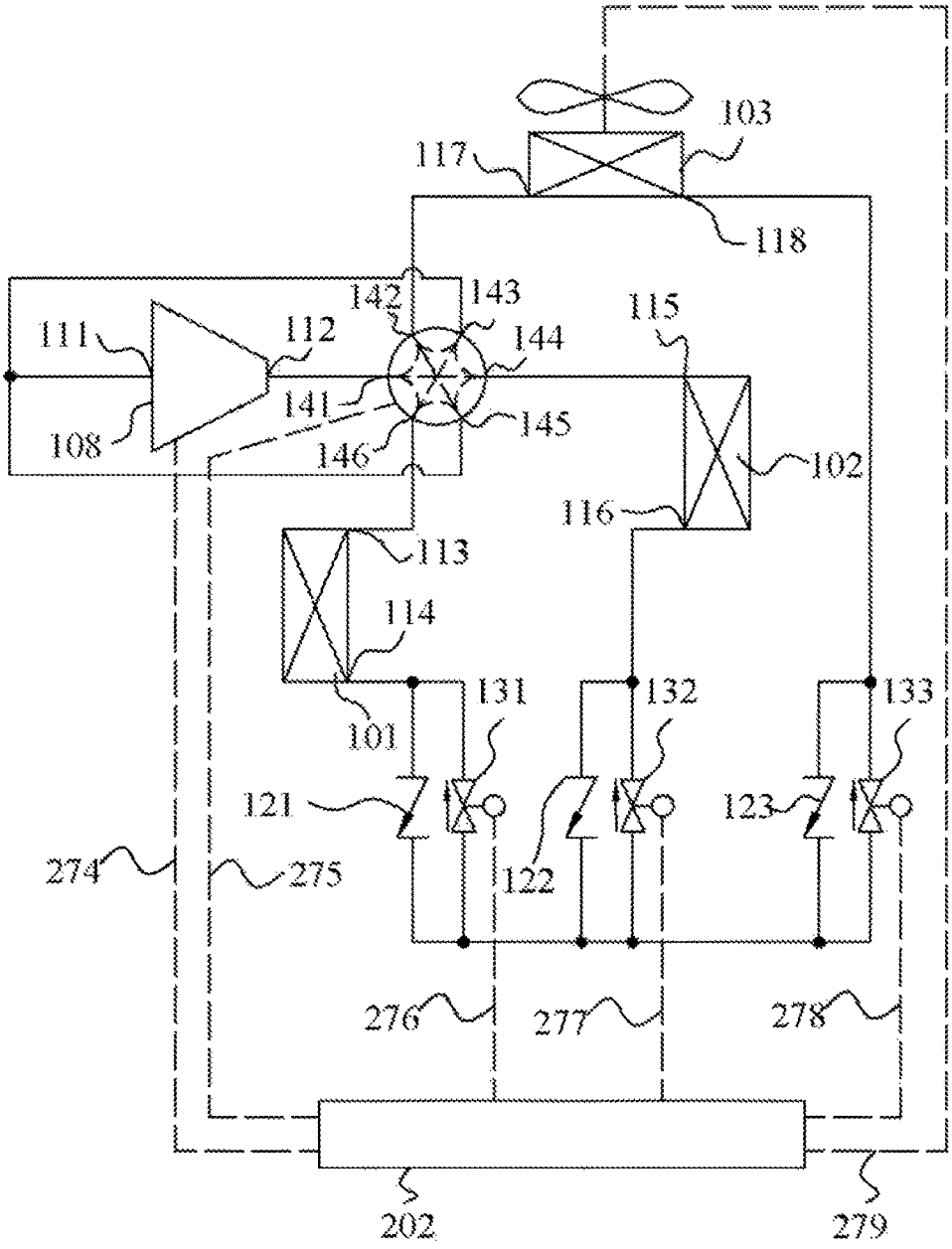
FIG. 2 is a schematic diagram of a communicative connection between a control device and each component in the heat pump system shown in FIG. 1.

FIG. 2 is a schematic diagram of a communicative connection between a control device 202 and each component of the heat pump system 100 shown in FIG. 1. As shown in FIG. 2, the heat pump system 100 includes a control device 202. The control device 202 is respectively communicatively connected to the compressor 108, the six-way valve 140, the first throttle device 131, the second throttle device 132, the third throttle device 133, and the fan 104 through connections 274, 275, 276, 277, 278, and 279 respectively. The control device 202 may control turn-on and turn-off of the compressor 108, control the six-way valve 140 to be in the first state, the second state, or the third state, control turn-on and turn-off of the first throttle device 131, the second throttle device 132, and the third throttle device 133, and control turn-on and turn-off of the fan 104.

Figure 3:
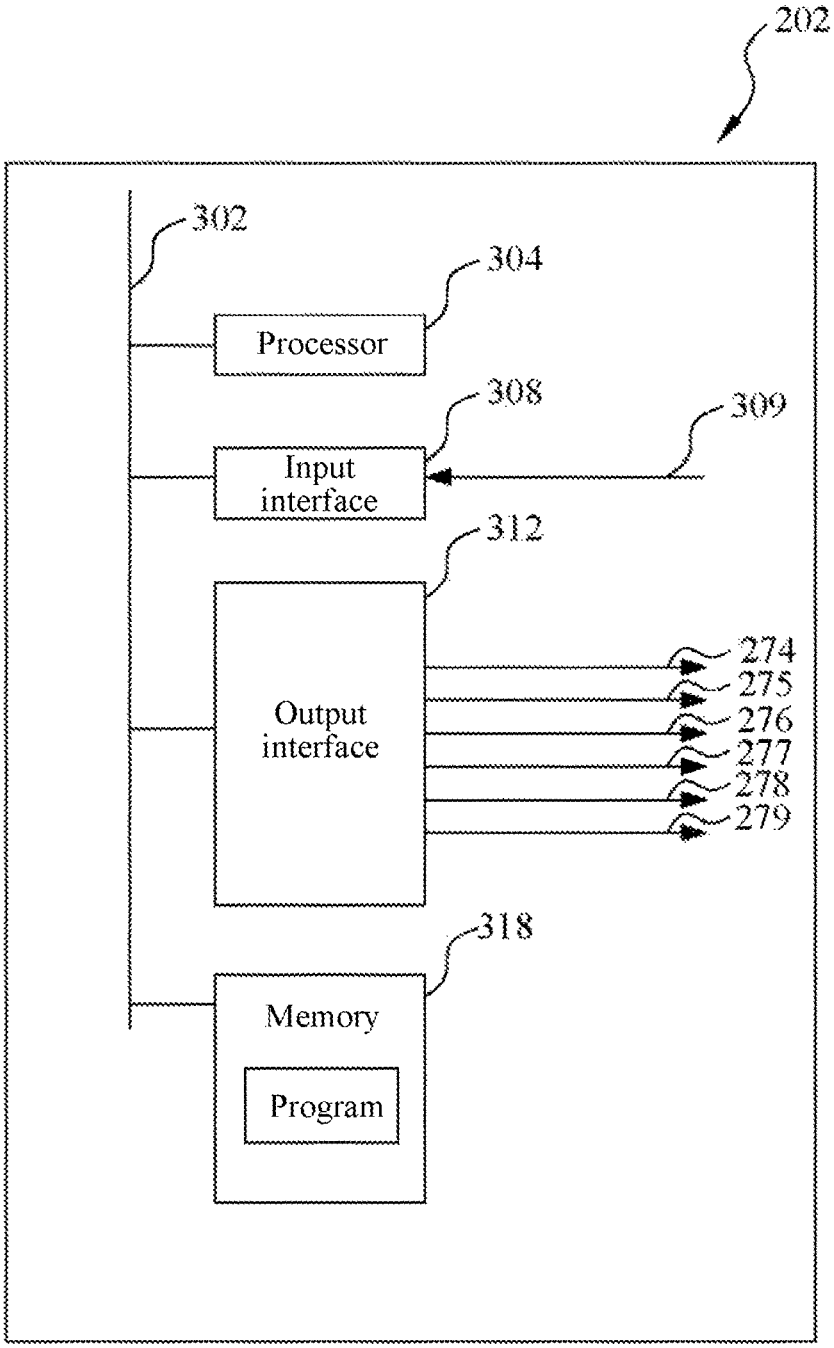
FIG. 3 is a schematic diagram of an internal structure of the control device in FIG. 2.

FIG. 3 is a schematic diagram of an internal structure of the control device 202 in FIG. 2. As shown in FIG. 3, the control device 202 includes a bus 302, a processor 304, an input interface 308, an output interface 312, and a memory 318 having a control program. The components in the control device 202, including the processor 304, the input interface 308, the output interface 312, and the memory 318 are communicatively connected to the bus 302, so that the processor 304 can control operation of the input interface 308, the output interface 312, and the memory 318. Specifically, the memory 318 is configured to store a program, an instruction, and data, and the processor 304 reads the program, the instruction, and the data from the memory 318 and can write the data to the memory 318. The processor 304 controls the operation of the input interface 308 and the output interface 312 by executing the program and the instruction from the memory 318. As shown in FIG. 3, the output interface 312 is communicatively connected to the compressor 108, the six-way valve 140, the first throttle device 131, the second throttle device 132, the third throttle device 133, and the fan 104 through the connections 274, 275, 276, 277, 278, and 279 respectively. The input interface 308 receives an operation request of the heat pump system 100 and other operation parameters through a connector 309. The processor 304 controls the operation of the heat pump system 100 by executing the program and the instruction in the memory 318. More specifically, the control device 202 may receive, through the input interface 308, a request to control the operation of the heat pump system 100 (for example, the request is transmitted through a control panel), and transmit a control signal to each controlled component through the output interface 312, so that the heat pump system 100 can operate in a plurality of operating modes and can be switched between various operating modes.

In the heat pump system 100 of this application, the six-way valve 140, the first throttle device 131, the second throttle device 132, the third throttle device 133, and the fan 104 are specifically controlled to achieve a plurality of operating modes including a separate cooling mode, a separate heating mode, a separate hot water production mode, a cooling and hot water production mode, and a hot water production and defrosting mode. The connection between the components of the heat pump system 100 in this application is simple, and the control logic therefore is simple.

FIG. 4 to FIG. 8 are system diagrams of the heat pump system 100 shown in FIG. 1, showing a refrigerant loop of the heat pump system 100 in different operating modes, where an arrow represents a flowing direction and a flowing path of a refrigerant. The operating modes shown in FIG. 4 to FIG. 8 are detailed below.

Figure 4:
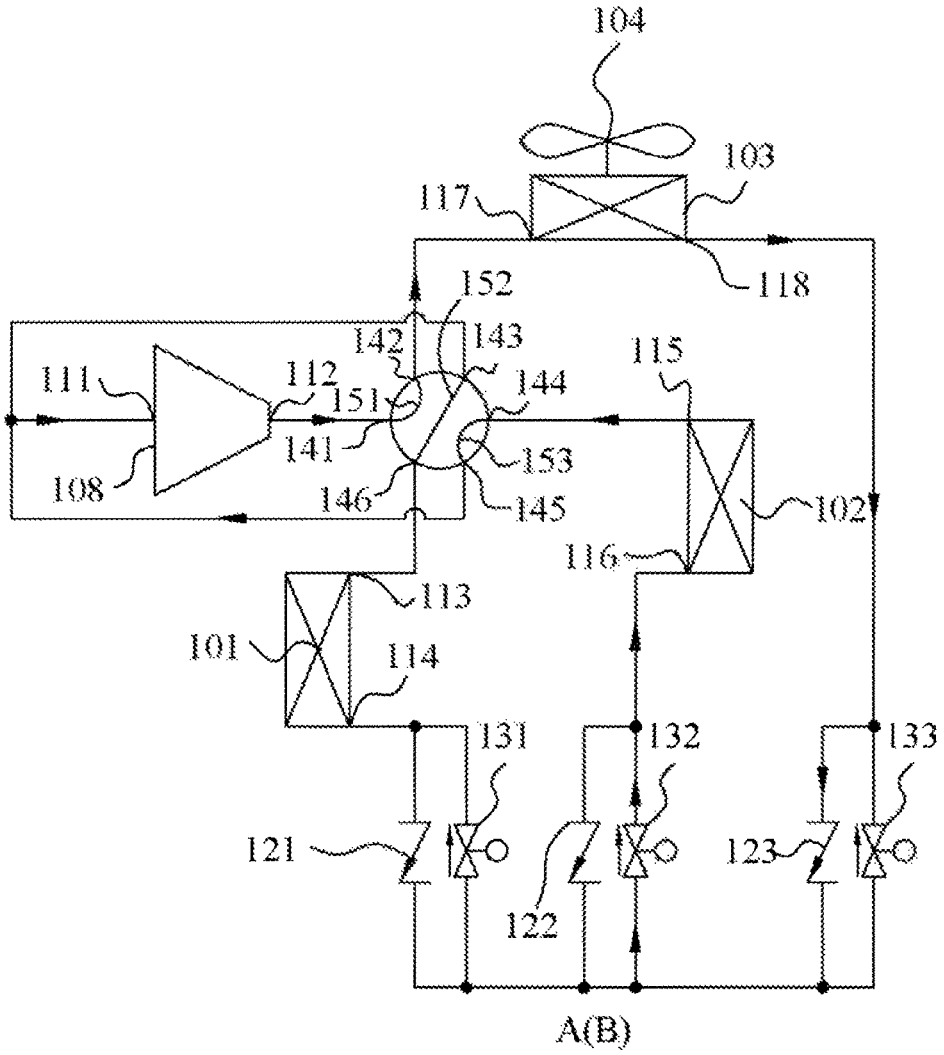
FIG. 4 is a system diagram of the heat pump system shown in FIG. 1 in a separate cooling mode.

FIG. 4 is a system diagram of the heat pump system 100 shown in FIG. 1 in a separate cooling mode. As shown in FIG. 4, through control of the control device 202, the six-way valve 140 is in the first state, the second throttle device 132 is turned on, the first throttle device 131 and the third throttle device 133 are turned off, and the fan 104 is turned on.

Specifically, a high-temperature and high-pressure gaseous refrigerant flowing out through the fluid discharge port 112 of the compressor 108 flows into the third heat exchanger 103 through the first port 141, the first circulation channel 151, and the second port 142 of the six-way valve 140 successively. In the third heat exchanger 103, the high-temperature and high-pressure gaseous refrigerant exchanges heat with the air, thereby changing the high-temperature and high-pressure gaseous refrigerant into a high-pressure liquid refrigerant. The high-pressure liquid refrigerant flows out from the third heat exchanger 103 and successively passes through the third control valve 123, the path converging point A, and the second throttle device 132. The high-pressure liquid refrigerant flows through the second throttle device 132 and then becomes a low-temperature and low-pressure refrigerant, and then flows into the second heat exchanger 102. In the second heat exchanger 102, the low-temperature and low-pressure refrigerant exchanges heat with a fluid with a higher temperature on a user side, thereby reducing a temperature of the fluid on the user side to provide a fluid with a lower temperature for the user side (for example, to provide air conditioner cold water). The low-temperature and low-pressure refrigerant exchanges heat with the fluid on the user side in the second heat exchanger 102 and becomes a low-pressure gaseous refrigerant. The low-pressure gaseous refrigerant successively passes through the fourth port 144, the third circulation channel 153, and the fifth port 145 of the six-way valve 140, and then enters the compressor 108 again through the fluid suction port 111 of the compressor 108 and becomes a high-temperature and high-pressure gaseous refrigerant, thereby completing a cycle of the refrigerant.

In this way, when the heat pump system 100 is in the separate cooling mode, the compressor 108, the third heat exchanger 103, the second throttle device 132, and the second heat exchanger 102 are connected in the refrigerant loop. The third heat exchanger 103 is used as a condenser, and the second heat exchanger 102 is used as an evaporator. The first heat exchanger 101 is not in the refrigerant loop.

It should be noted that since the first throttle device 131 is turned off at this time, the refrigerant does not flow into the first heat exchanger 101 through the second circulation port 114. In addition, the first circulation port 113 of the first heat exchanger 101 is in fluid communication with the fluid suction port 111 of the compressor 108 through the second circulation channel 152. Therefore, at least part of the refrigerant accumulated in the first heat exchanger 101 can successively pass through the first circulation port 113 of the first heat exchanger 101, the sixth port 146, the second circulation channel 152, and the third port 143, and then flow into the compressor 108 through the fluid suction port 111 of the compressor 108.

Figure 5:
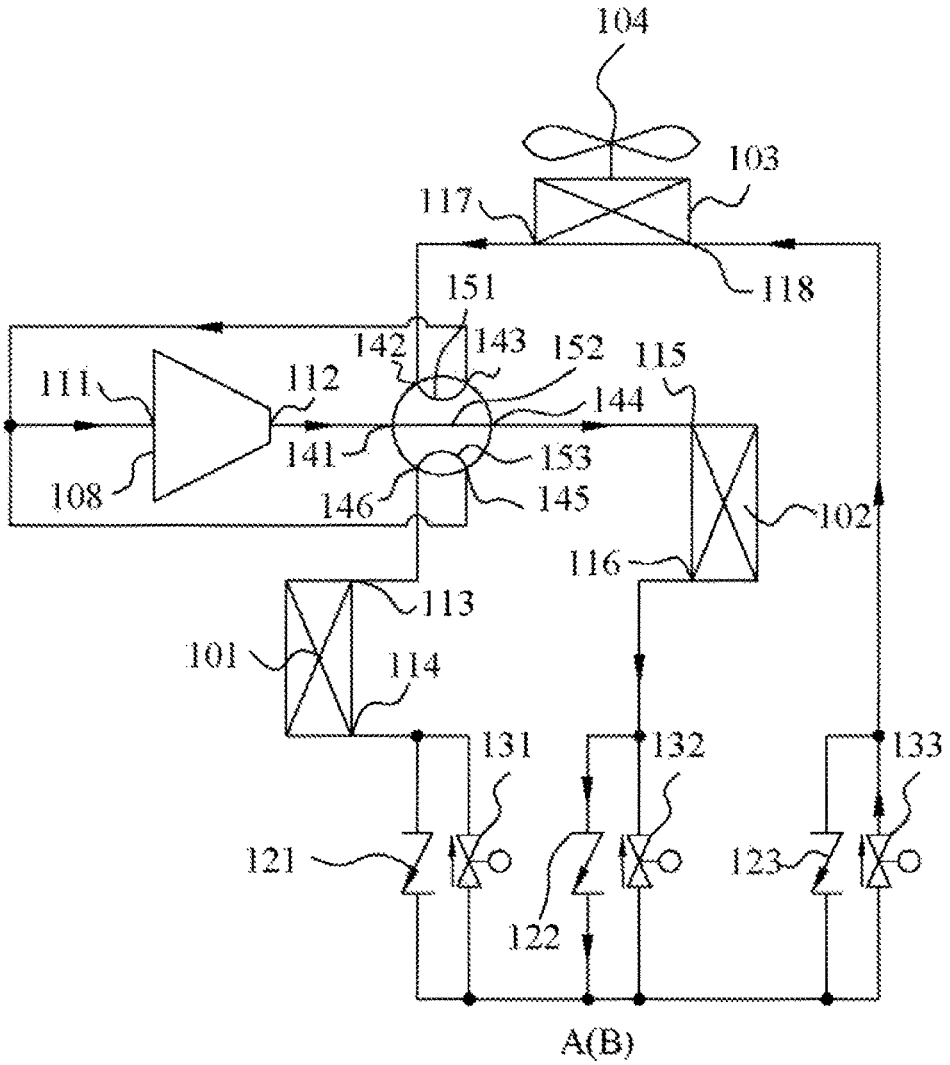
FIG. 5 is a system diagram of the heat pump system shown in FIG. 1 in a separate heating mode.

FIG. 5 is a system diagram of the heat pump system 100 shown in FIG. 1 in a separate heating mode. As shown in FIG. 5, through control of the control device 202, the six-way valve 140 is in the second state, the third throttle device 133 is turned on, the first throttle device 131 and the second throttle device 132 are turned off, and the fan 104 is turned on.

Specifically, a high-temperature and high-pressure gaseous refrigerant flowing out through the fluid discharge port 112 of the compressor 108 flows into the second heat exchanger 102 through the first port 141, the second circulation channel 152, and the fourth port 144 of the six-way valve 140 successively. In the second heat exchanger 102, the high-temperature and high-pressure gaseous refrigerant exchanges heat with a fluid with a lower temperature on the user side, thereby increasing the temperature of the fluid on the user side to provide a fluid with a higher temperature for the user (for example, to provide air conditioner hot water). The high-temperature and high-pressure gaseous refrigerant exchanges heat with the fluid on the user side in the second heat exchanger 102 and becomes a high-pressure gaseous refrigerant. The high-pressure liquid refrigerant flows out from the second heat exchanger 102 and successively passes through the second control valve 122, the path converging point A, and the third throttle device 133. The high-pressure liquid refrigerant flows through the third throttle device 133 and then becomes a low-temperature and low-pressure refrigerant, and then flows into the third heat exchanger 103. In the third heat exchanger 103, the low-temperature and low-pressure refrigerant exchanges heat with the air, thereby changing the low-temperature and low-pressure refrigerant into a low-pressure gaseous refrigerant. The low-pressure gaseous refrigerant successively passes through the second port 142, the first circulation channel 151, and the third port 143 of the six-way valve 140, and then enters the compressor 108 again through the fluid suction port 111 of the compressor 108 and becomes a high-temperature and high-pressure gaseous refrigerant, thereby completing a cycle of the refrigerant.

In this way, when the heat pump system 100 is in the separate heating mode, the compressor 108, the second heat exchanger 102, the third throttle device 133, and the third heat exchanger 103 are connected in the refrigerant loop. The second heat exchanger 102 is used as a condenser, and the third heat exchanger 103 is used as an evaporator. The first heat exchanger 101 is not in the refrigerant loop.

It should be noted that since the first throttle device 131 is turned off at this time, the refrigerant does not flow into the first heat exchanger 101 through the second circulation port 114. In addition, the first circulation port 113 of the first heat exchanger 101 is in fluid communication with the fluid suction port 111 of the compressor 108 through the third circulation channel 153. Therefore, at least part of the refrigerant accumulated in the first heat exchanger 101 can successively pass through the first circulation port 113 of the first heat exchanger 101, the sixth port 146, the third circulation channel 153, and the fifth port 145, and then flow into the compressor 108 through the fluid suction port 111 of the compressor 108.

Figure 6:
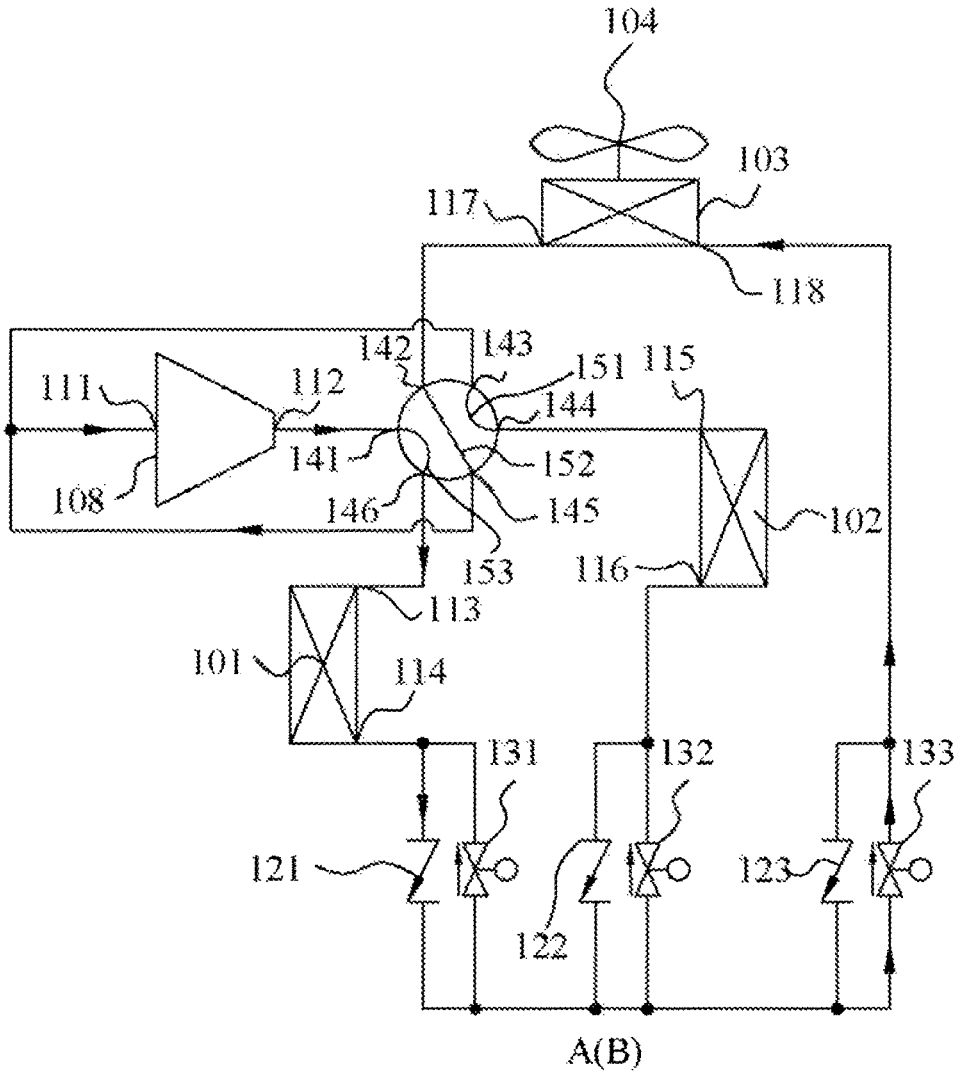
FIG. 6 is a system diagram of the heat pump system shown in FIG. 1 in a separate hot water production mode.

FIG. 6 is a system diagram of the heat pump system 100 shown in FIG. 1 in a separate hot water production mode. As shown in FIG. 6, through control of the control device 202, the six-way valve 140 is in the third state, the third throttle device 133 is turned on, the first throttle device 131 and the second throttle device 132 are turned off, and the fan 104 is turned on.

Specifically, a high-temperature and high-pressure gaseous refrigerant flowing out through the fluid discharge port 112 of the compressor 108 flows into the first heat exchanger 101 through the first port 141, the third circulation channel 153, and the sixth port 146 of the six-way valve 140 successively. In the first heat exchanger 101, the high-temperature and high-pressure gaseous refrigerant exchanges heat with a fluid with a lower temperature on the user side, thereby increasing the temperature of the fluid on the user side to provide a fluid with a higher temperature for the user (for example, to provide domestic hot water). The high-temperature and high-pressure gaseous refrigerant exchanges heat with the fluid on the user side in the first heat exchanger 101 and becomes a high-pressure gaseous refrigerant. The high-pressure liquid refrigerant flows out from the first heat exchanger 101 and successively passes through the first control valve 121, the path converging point A, and the third throttle device 133. The high-pressure liquid refrigerant flows through the third throttle device 133 and then becomes a low-temperature and low-pressure refrigerant, and then flows into the third heat exchanger 103. In the third heat exchanger 103, the low-temperature and low-pressure refrigerant exchanges heat with the air, thereby changing the low-temperature and low-pressure refrigerant into a low-pressure gaseous refrigerant. The low-pressure gaseous refrigerant successively passes through the second port 142, the second circulation channel 152, and the fifth port 145 of the six-way valve 140, and then enters the compressor 108 again through the fluid suction port 111 of the compressor 108 and becomes a high-temperature and high-pressure gaseous refrigerant, thereby completing a cycle of the refrigerant.

In this way, when the heat pump system 100 is in the separate hot water production mode, the compressor 108, the first heat exchanger 101, the third throttle device 133, and the third heat exchanger 103 are connected in the refrigerant loop. The first heat exchanger 101 is used as a condenser, and the third heat exchanger 103 is used as an evaporator. The second heat exchanger 102 is not in the refrigerant loop.

It should be noted that since the second throttle device 132 is turned off at this time, the refrigerant does not flow into the second heat exchanger 102 through the second circulation port 116. In addition, the first circulation port 115 of the second heat exchanger 102 is in fluid communication with the fluid suction port 111 of the compressor 108 through the first circulation channel 151. Therefore, at least part of the refrigerant accumulated in the second heat exchanger 102 can successively pass through the first circulation port 115 of the second heat exchanger 102, the fourth port 144, the first circulation channel 151, and the third port 143, and then flow into the compressor 108 through the fluid suction port 111 of the compressor 108.

When the third heat exchanger 103 in the heat pump system 100 adopts the air side heat exchanger (that is, the air source heat exchanger) shown in FIG. 1, the heat pump system 100 further includes a hot water production and defrosting mode. A reason is as follows. When the heat pump system 100 is in the separate hot water production mode, and the air side heat exchanger is in a low-temperature and high-humidity environment, water vapor in the air in the environment condenses on the third heat exchanger 103 and forms frost after contacting the third heat exchanger 103 having a low temperature, which affects heat exchange efficiency of the third heat exchanger 103. Therefore, when the heat pump system 100 is in the separate hot water production mode, the control device 202 may determine whether the frost formed on the third heat exchanger 103 affects the heat exchange efficiency of the third heat exchanger 103. If the control device 202 determines that the frost formed on the third heat exchanger 103 affects the heat exchange efficiency of the third heat exchanger 103, the control device 202 switches the heat pump system 100 to the following hot water production and defrosting mode. As an example, the control device 202 may determine whether to switch to the hot water production and defrosting mode according to a current ambient temperature and a system state parameter.

Figure 7:
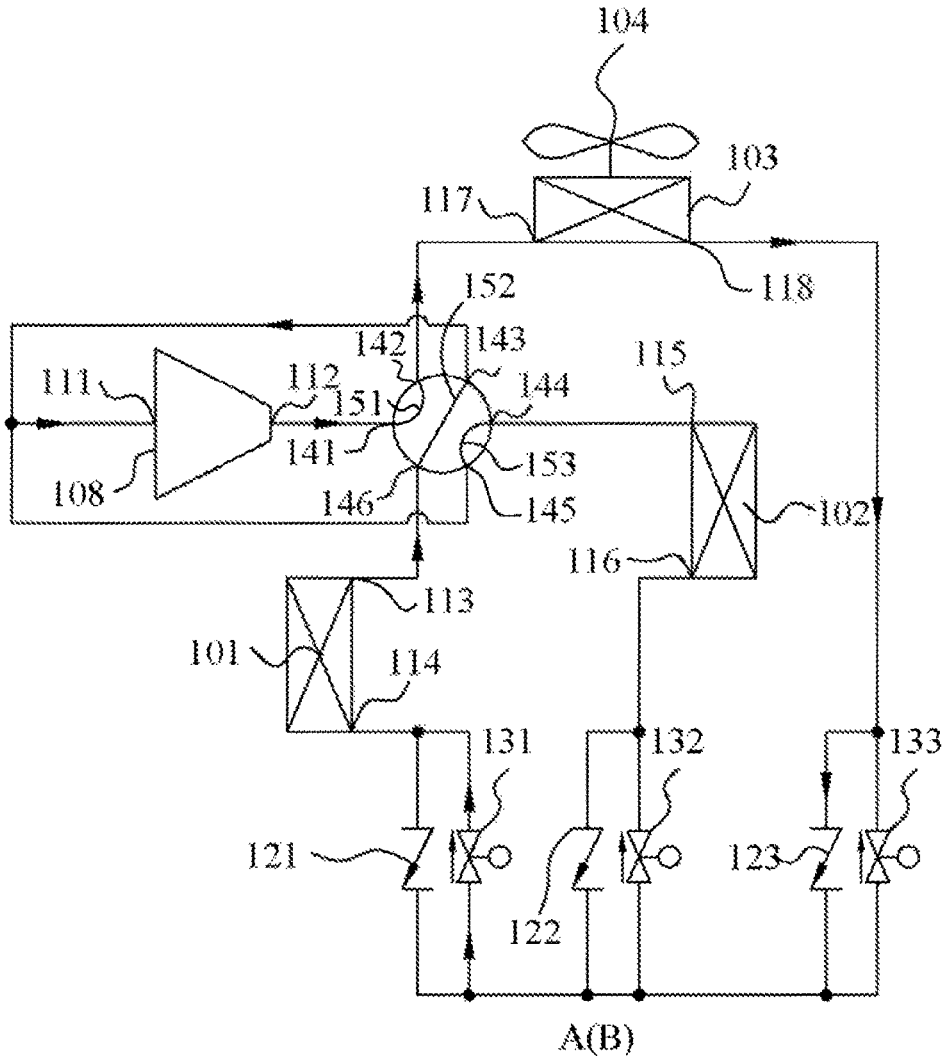
FIG. 7 is a system diagram of the heat pump system shown in FIG. 1 in a hot water production and defrosting mode.

FIG. 7 is a system diagram of the heat pump system 100 shown in FIG. 1 in a hot water production and defrosting mode. As shown in FIG. 7, through control of the control device 202, the six-way valve 140 is in the first state, the first throttle device 131 is turned on, the second throttle device 132 and the third throttle device 133 are turned off, and the fan 104 is turned off.

Specifically, a high-temperature and high-pressure gaseous refrigerant flowing out through the fluid discharge port 112 of the compressor 108 flows into the third heat exchanger 103 through the first port 141, the first circulation channel 151, and the second port 142 of the six-way valve 140 successively. In the third heat exchanger 103, the high-temperature and high-pressure gaseous refrigerant transfers heat to the frost that condenses on the third heat exchanger 103, so that the frost melts. At this time, the fan 104 in the third heat exchanger 103 is not turned on. The high-temperature and high-pressure gaseous refrigerant changes into the high-pressure liquid refrigerant in the third heat exchanger 103 and then successively passes through the third control valve 123, the path converging point A, and the first throttle device 131. The high-pressure liquid refrigerant flows through the first throttle device 131 and then becomes a low-temperature and low-pressure refrigerant, and then flows into the first heat exchanger 101. In the first heat exchanger 101, the low-temperature and low-pressure refrigerant exchanges heat with the fluid on the user side in the first heat exchanger 101, thereby changing the low-temperature and low-pressure refrigerant into a low-pressure gaseous refrigerant. The low-pressure gaseous refrigerant successively passes through the sixth port 146, the second circulation channel 152, and the third port 143 of the six-way valve 140, and then enters the compressor 108 through the fluid suction port 111 of the compressor 108 and becomes a high-temperature and high-pressure gaseous refrigerant, thereby completing a cycle of the refrigerant.

In this way, when the heat pump system 100 is in the hot water production and defrosting mode, the compressor 108, the third heat exchanger 103, the first throttle device 131, and the first heat exchanger 101 are connected in the refrigerant loop. The third heat exchanger 103 is used as a condenser, and the first heat exchanger 101 is used as an evaporator. The second heat exchanger 102 is not in the refrigerant loop.

It should be noted that since the second throttle device 132 is turned off at this time, the refrigerant does not flow into the second heat exchanger 102 through the second circulation port 116. In addition, the first circulation port 115 of the second heat exchanger 102 is in fluid communication with the fluid suction port 111 of the compressor 108 through the third circulation channel 153. Therefore, at least part of the refrigerant accumulated in the second heat exchanger 102 can successively pass through the first circulation port 115 of the second heat exchanger 102, the fourth port 144, the third circulation channel 153, and the fifth port 145, and then flow into the compressor 108 through the fluid suction port 111 of the compressor 108.

After the heat pump system 100 performs the hot water production and defrosting mode for a period of time, the control device 202 may switch the operating mode to the separate hot water production mode, so as to further provide a fluid with a relatively high temperature (for example, provide the domestic hot water) for the user side through the first heat exchanger 101.

It should be noted that in addition to the defrosting of the third heat exchanger 103 in the separate hot water production mode, the third heat exchanger 103 in the separate heating mode shown in FIG. 5 also requires defrosting. Specifically, when the heat pump system 100 is in the separate heating mode, the control device 202 may determine whether the frost formed on the third heat exchanger 103 affects the heat exchange efficiency of the third heat exchanger 103. If the control device 202 determines that the frost formed on the third heat exchanger 103 affects the heat exchange efficiency of the third heat exchanger 103, the control device 202 switches the heat pump system 100 to the following hot water production and defrosting mode. In the hot water production and defrosting mode, a pipeline connection among the components is the same as that of the separate cooling mode shown in FIG. 4. Therefore, the hot water production and defrosting mode is described with reference to FIG. 4. As shown in FIG. 4, through control of the control device 202, the six-way valve 140 is in the first state, the second throttle device 132 is turned on, the first throttle device 131 and the third throttle device 133 are turned off, and the fan 104 is turned off.

Specifically, a high-temperature and high-pressure gaseous refrigerant flowing out through the fluid discharge port 112 of the compressor 108 flows into the third heat exchanger 103 through the first port 141, the first circulation channel 151, and the second port 142 of the six-way valve 140 successively. In the third heat exchanger 103, the high-temperature and high-pressure gaseous refrigerant transfers heat to the frost that condenses on the third heat exchanger 103, so that the frost melts. At this time, the fan 104 in the third heat exchanger 103 is not turned on. The high-temperature and high-pressure gaseous refrigerant changes into the high-pressure liquid refrigerant in the third heat exchanger 103 and then successively passes through the third control valve 123, the path converging point A, and the second throttle device 132. The high-pressure liquid refrigerant flows through the second throttle device 132 and then becomes a low-temperature and low-pressure refrigerant, and then flows into the second heat exchanger 102. In the second heat exchanger 102, the low-temperature and low-pressure refrigerant exchanges heat with the fluid on the user side in the second heat exchanger 102, thereby changing the low-temperature and low-pressure refrigerant into a low-pressure gaseous refrigerant. The low-pressure gaseous refrigerant successively passes through the fourth port 144, the third circulation channel 153, and the fifth port 145 of the six-way valve 140, and then enters the compressor 108 again through the fluid suction port 111 of the compressor 108 and becomes a high-temperature and high-pressure gaseous refrigerant, thereby completing a cycle of the refrigerant.

In this way, when the heat pump system 100 is in the hot water production and defrosting mode, the compressor 108, the third heat exchanger 103, the second throttle device 132, and the second heat exchanger 102 are connected in the refrigerant loop. The third heat exchanger 103 is used as a condenser, and the second heat exchanger 102 is used as an evaporator. The first heat exchanger 101 is not in the refrigerant loop.

It should be noted that since the first throttle device 131 is turned off at this time, the refrigerant does not flow into the first heat exchanger 101 through the second circulation port 114. In addition, the first circulation port 113 of the first heat exchanger 101 is in fluid communication with the fluid suction port 111 of the compressor 108 through the second circulation channel 152. Therefore, at least part of the refrigerant accumulated in the first heat exchanger 101 can successively pass through the first circulation port 113 of the first heat exchanger 101, the sixth port 146, the second circulation channel 152, and the third port 143, and then flow into the compressor 108 through the fluid suction port 111 of the compressor 108.

After the heat pump system 100 performs the hot water production and defrosting mode for a period of time, the control device 202 may switch the operating mode to the separate heating mode, so as to further provide a fluid with a relatively high temperature (for example, provide air conditioner hot water) for the user side through the second heat exchanger 102.

Figure 8:
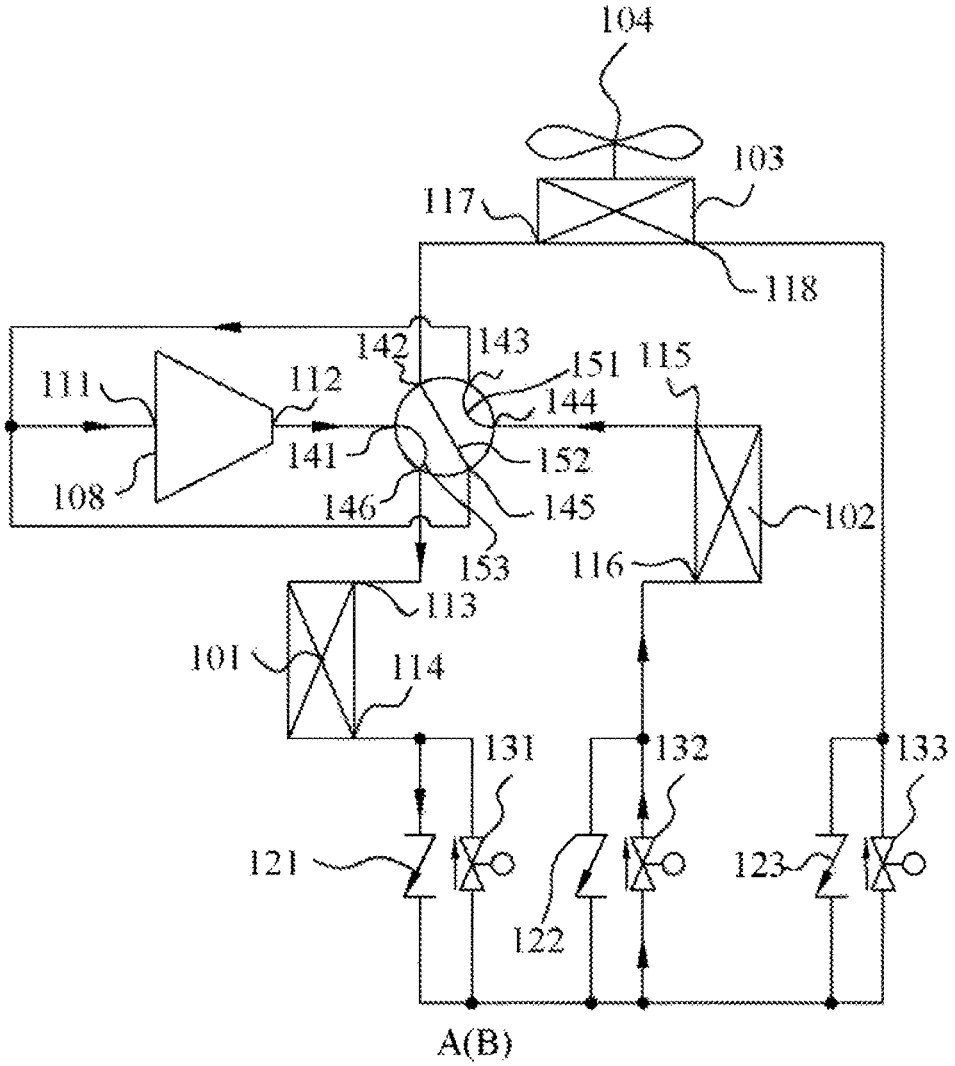
FIG. 8 is a system diagram of the heat pump system shown in FIG. 1 in a cooling and hot water production mode.

FIG. 8 is a system diagram of the heat pump system 100 shown in FIG. 1 in a cooling and hot water production mode. As shown in FIG. 8, through control of the control device 202, the six-way valve 140 is in the third state, the second throttle device 132 is turned on, the first throttle device 131 and the third throttle device 133 are turned off, and the fan 104 is turned off.

Specifically, a high-temperature and high-pressure gaseous refrigerant flowing out through the fluid discharge port 112 of the compressor 108 flows into the first heat exchanger 101 through the first port 141, the third circulation channel 153, and the sixth port 146 of the six-way valve 140 successively. In the first heat exchanger 101, the high-temperature and high-pressure gaseous refrigerant exchanges heat with a fluid with a lower temperature on the user side, thereby increasing the temperature of the fluid on the user side to provide a fluid with a higher temperature for the user (for example, to provide domestic hot water). The high-temperature and high-pressure gaseous refrigerant exchanges heat with the fluid on the user side in the first heat exchanger 101 and becomes a high-pressure gaseous refrigerant. The high-pressure liquid refrigerant flows out from the first heat exchanger 101 and successively passes through the first control valve 121, the path converging point A, and the second throttle device 132. The high-pressure liquid refrigerant flows through the second throttle device 132 and then becomes a low-temperature and low-pressure refrigerant, and then flows into the second heat exchanger 102. In the second heat exchanger 102, the low-temperature and low-pressure refrigerant exchanges heat with a fluid with a higher temperature on a user side, thereby reducing a temperature of the fluid on the user side to provide a fluid with a lower temperature for the user (for example, to provide air conditioner cold water). The low-temperature and low-pressure refrigerant exchanges heat with the fluid on the user side in the second heat exchanger 102 and becomes a low-pressure gaseous refrigerant. The low-pressure gaseous refrigerant successively passes through the fourth port 144, the first circulation channel 151, and the third port 143 of the six-way valve 140, and then enters the compressor 108 again through the fluid suction port 111 of the compressor 108 and becomes a high-temperature and high-pressure gaseous refrigerant, thereby completing a cycle of the refrigerant.

In this way, when the heat pump system 100 is in the cooling and hot water production mode, the compressor 108, the first heat exchanger 101, the second throttle device 132, and the second heat exchanger 102 are connected in the refrigerant loop. The first heat exchanger 101 is used as a condenser, and the second heat exchanger 102 is used as an evaporator. The third heat exchanger 103 is not in the refrigerant loop.

It should be noted that since the third throttle device 133 is turned off at this time, the refrigerant does not flow into the third heat exchanger 103 through the second circulation port 118. In addition, the first circulation port 117 of the third heat exchanger 103 is in fluid communication with the fluid suction port 111 of the compressor 108 through the second circulation channel 152. Therefore, at least part of the refrigerant accumulated in the third heat exchanger 103 can successively pass through the first circulation port 117 of the third heat exchanger 103, the second port 142, the second circulation channel 152, and the fifth port 145, and then flow into the compressor 108 through the fluid suction port 111 of the compressor 108.

In order to implement the plurality of operating modes, a conventional heat pump system usually requires at least two four-way valves, or four-way valves and three-way valves connected in series. The pipeline of the heat pump system is complex, the pressure drop during fluid suction and discharge is large, the costs are high, and the control logic therefore is complex.

However, the heat pump system 100 in this application can implement the plurality of operating modes through the control of the six-way valve 140 and the three circulation paths (that is, the first circulation path, the second circulation path, and the third circulation path). More specifically, the control device 202 needs to control the six-way valve 140, the first throttle device 131, the second throttle device 132, and the third throttle device 133. The components of the heat pump system 100 have simple pipelines, have a high degree of integration, can be easily mounted, and have a small pressure drop during fluid suction and discharge, and the control logic therefor is simple.

Figure 9:
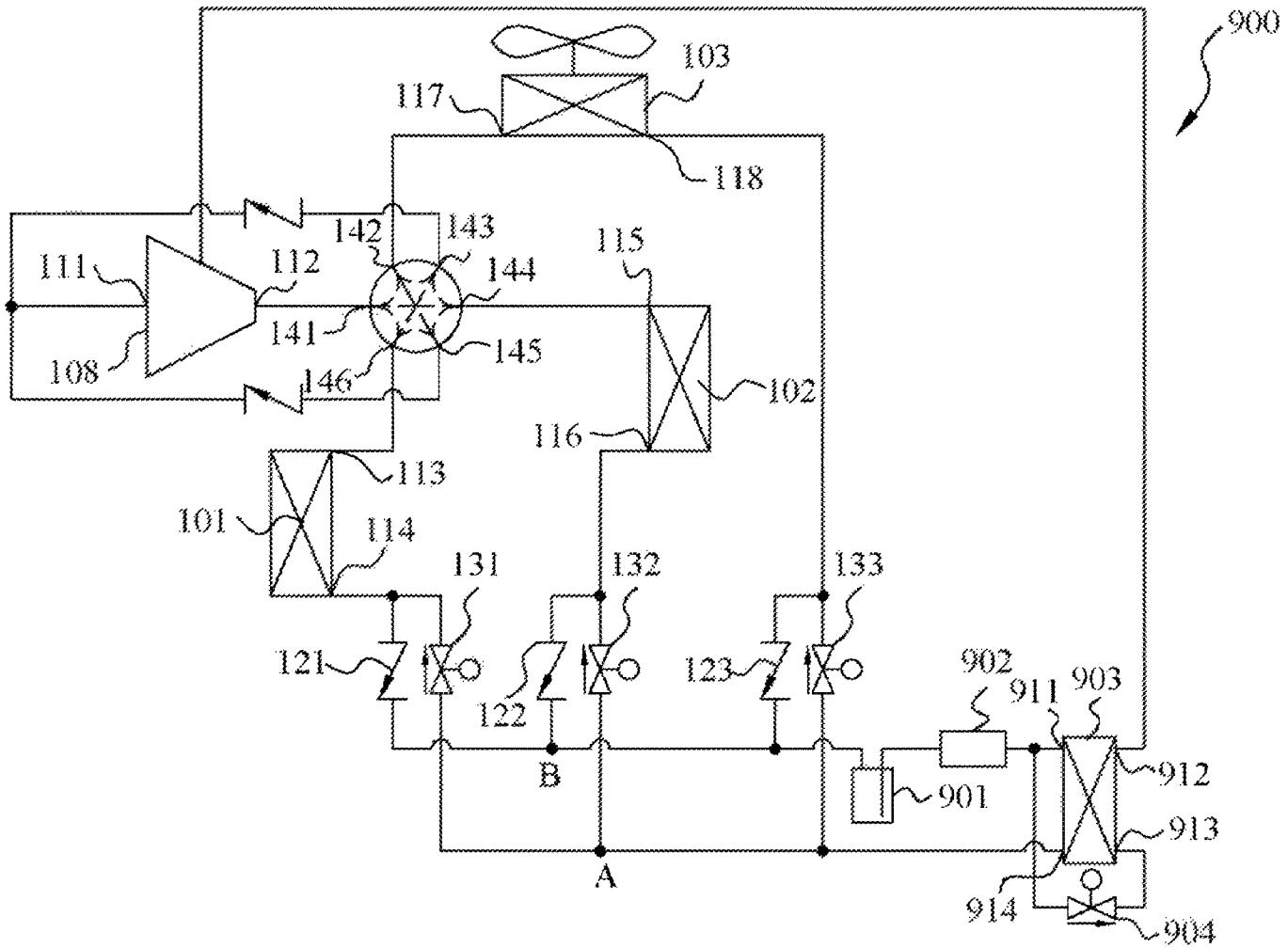
FIG. 9 is a system diagram of a heat pump system according to a second embodiment of this application.

FIG. 9 is a system diagram of a heat pump system 900 according to a second embodiment of this application. The heat pump system 900 shown in FIG. 9 is substantially the same as the heat pump system 100 shown in FIG. 1, and the similarities are not described herein again. Unlike the heat pump system 100 shown in FIG. 1, the heat pump system 900 shown in FIG. 9 further includes an additional component, and the path converging point A and the bypass converging point B in the heat pump system 900 are two different points. The path converging point A and the bypass converging point B are in fluid communication with the pipeline through the additional component.

As shown in FIG. 9, the heat pump system 900 further includes a reservoir 901, a filter dryer 902, an additional heat exchanger 903, and an additional throttle device 904. The reservoir 901 is configured to adjust an amount of the refrigerant in the heat pump system 900. The filter dryer 902 is configured to filter out dust and debris in the refrigerant and to remove moisture from the refrigerant. The additional heat exchanger 903 and the additional throttle device 904 may form an economizer to improve efficiency of the heat pump system 900.

Specifically, an inlet of reservoir 901 is connected to the bypass converging point B. The inlet of reservoir 901 is connected to an inlet of the filter dryer 902. An outlet of the filter dryer 902 is connected to a first circulation port 911 of the additional heat exchanger 903, and is connected to a throttle inlet of the additional throttle device 904. A second circulation port 912 of the additional heat exchanger 903 is connected to a compression cavity (not shown) in the compressor 108. A third circulation port 913 of the additional heat exchanger 903 is connected to a throttle outlet of the additional throttle device 904. A fourth circulation port 914 of the additional heat exchanger 903 is connected to the path converging point A. It should be noted that in the additional heat exchanger 903, the first circulation port 911 is in fluid communication with the fourth circulation port 914, and a first flowing path is formed in the additional heat exchanger 903; and the second circulation port 912 is in fluid communication with the third circulation port 913, and a second flowing path is formed in the additional heat exchanger 903. A fluid in the first flowing path may exchange heat with a fluid in the second flowing path.

The heat pump system 900 can implement the plurality of operating modes of the heat pump system 100 through the similar control in the heat pump system 100. Details are not described herein again. No matter what operating mode the heat pump system 900 is in, a fluid flowing out from the control valve (that is, the first control valve 121, the second control valve 122, and the third control valve 123) is a high-pressure liquid refrigerant. The high-pressure liquid refrigerant flows through the reservoir 901 and the filter dryer 902 successively and is split into two channels. One channel passes through the additional throttle device 904 through the throttle inlet of the additional throttle device 904. The high-pressure liquid refrigerant becomes a low-temperature and low-pressure refrigerant at the additional throttle device 904 and then flows into the additional heat exchanger 903 through the third circulation port 913 of the additional heat exchanger 903. The other channel enters the additional heat exchanger 903 through the first circulation port 911. In the additional heat exchanger 903, the fluid entering the additional heat exchanger 903 through the first circulation port 911 is further cooled by the fluid flowing into the additional heat exchanger 903 through the third circulation port 913 and then flows out through the fourth circulation port 914, and then flows to the throttle device (that is, the first throttle device 131, the second throttle device 132, and the third throttle device 133) after passing through the path converging point A. The fluid flowing into the additional heat exchanger 903 through the third circulation port 913 is heated and then flows to the compression cavity (not shown) in the compressor 108 through the second circulation port 912. The arrangement of the economizer can further reduce a temperature of the refrigerant flowing through the throttle device (that is, the first throttle device 131, the second throttle device 132, and the third throttle device 133), and can reduce a discharge temperature of the compressor 108, thus improving the efficiency of the heat pump system 100.

It should be noted that although the embodiments of this application show the six-way valve 140 with a specific communicated structure, those skilled in the art may understand that any six-way valve that can realize the above connection and switching manner falls within the protection scope of this application. For example, the six-way valve includes six ports, one of the six ports is in communication with the fluid discharge port 112 of the compressor 108, two of the six ports are in communication with the fluid suction port 111 of the compressor 108, and remaining three ports are respectively in communication with the first end of the first circulation path, the first end of the second circulation path, and the first end of the third circulation path.

Although only some features of the application are illustrated and described herein, various improvements and changes can be made for those skilled in the art. Therefore, it should be understood that the appended claims are intended to cover all the above improvements and changes that fall within the substantive scope of the present application.

What is claimed is:

1. A heat pump system, comprising:

a compressor, wherein the compressor comprises a fluid suction port and a fluid discharge port;

a first heat exchanger, wherein the first heat exchanger is arranged in a first circulation path;

a second heat exchanger, wherein the second heat exchanger is arranged in a second circulation path;

a third heat exchanger, wherein the third heat exchanger is arranged in a third circulation path; and a six-way valve, wherein:

the first circulation path, the second circulation path, and the third circulation path are parallel paths, a first end of the first circulation path, a first end of the second circulation path, and a first end of the third circulation path are connected to the six-way valve, and are in controllable communication with the fluid suction port and the fluid discharge port of the compressor through the six-way valve, a second end of the first circulation path, a second end of the second circulation path, and a second end of the third circulation path are connected to a common path converging point, and the six-way valve comprises six ports, wherein one of the six ports is in communication with the fluid discharge port of the compressor, two of the six ports are in communication with the fluid suction port of the compressor, and a remaining three ports of the six ports are respectively in communication with the first end of the first circulation path, the first end of the second circulation path, and the first end of the third circulation path.

2. The heat pump system of claim 1, wherein the one of the six ports and the two of the six ports are paired with the remaining three ports of the six ports to form three circulation channels.

3. The heat pump system of claim 1, wherein:

the six-way valve comprises a first port, a second port, a third port, a fourth port, a fifth port, and a sixth port, wherein the first port is connected to the fluid discharge port of the compressor, the second port is connected to the first end of the third circulation path, the third port is connected to the fluid suction port of the compressor, the fourth port is connected to the first end of the second circulation path, the fifth port is connected to the fluid suction port of the compressor, and the sixth port is connected to the first end of the first circulation path, and the six-way valve has a first state, a second state, and a third state, and the six-way valve is configured such that:

when the six-way valve is in the first state, the first port is in communication with the second port, the third port is in communication with the sixth port, and the fourth port is in communication with the fifth port, when the six-way valve is in the second state, the second port is in communication with the third port, the first port is in communication with the fourth port, and the fifth port is in communication with the sixth port, and when the six-way valve is in the third state, the third port is in communication with the fourth port, the second port is in communication with the fifth port, and the first port is in communication with the sixth port.

4. The heat pump system of claim 3, further comprising:

a first throttle device, wherein the first throttle device is arranged in the first circulation path, and the first throttle device comprises a first throttle inlet and a first throttle outlet;

a second throttle device, wherein the second throttle device is arranged in the second circulation path, and the second throttle device comprises a second throttle inlet and a second throttle outlet; and a third throttle device, wherein the third throttle device is arranged in the third circulation path, and the third throttle device comprises a third throttle inlet and a third throttle outlet, wherein the first throttle inlet, the second throttle inlet, and the third throttle inlet are connected to the common path converging point.

5. The heat pump system of claim 4, further comprising:

a first bypass, a second bypass, a third bypass; and a first control valve, a second control valve, and a third control valve respectively arranged in the first bypass, the second bypass, and the third bypass, wherein a first end of the first bypass is connected to the first throttle outlet, a first end of the second bypass is connected to the second throttle outlet, a first end of the third bypass is connected to the third throttle outlet, a second end of the first bypass, a second end of the second bypass, and a second end of the third bypass are connected to a common bypass converging point to respectively controllably bypass the first throttle device, the second throttle device, and the third throttle device, so that the first heat exchanger, the second heat exchanger, and the third heat exchanger are in fluid communication with the common bypass converging point.

6. The heat pump system of claim 5, wherein:

the first control valve, the second control valve, and the third control valve are one-way valves, and the first control valve is configured such that a fluid flows from the first heat exchanger to the common bypass converging point through the first bypass, the second control valve is configured such that a fluid flows from the second heat exchanger to the common bypass converging point through the second bypass, and the third control valve is configured such that a fluid flows from the third heat exchanger to the common bypass converging point through the third bypass.

7. The heat pump system of claim 5, wherein:

the heat pump system is configured to implement a plurality of operating modes, and the plurality of operating modes comprises a separate cooling mode, and when the heat pump system is in the separate cooling mode, the six-way valve is maintained in the first state, the third control valve and the second throttle device are turned on, and the first control valve, the second control valve, the first throttle device, and the third throttle device are turned off, so that the compressor, the third heat exchanger, the second throttle device, and the second heat exchanger are connected in a refrigerant loop.

8. The heat pump system of claim 5, wherein:

the heat pump system is configured to implement a plurality of operating modes, and the plurality of operating modes comprise-comprises a separate heating mode, and when the heat pump system is in the separate heating mode, the six-way valve is maintained in the second state, the second control valve and the third throttle device are turned on, and the first control valve, the third control valve, the first throttle device, and the second throttle device are turned off, so that the compressor, the second heat exchanger, the third throttle device, and the third heat exchanger are connected in a refrigerant loop.

9. The heat pump system of claim 5, wherein:

the heat pump system is configured to implement a plurality of operating modes, and the plurality of operating modes comprises a separate hot water production mode, and when the heat pump system is in the separate hot water production mode, the six-way valve is maintained in the third state, the first control valve and the third throttle device are turned on, and the second control valve, the third control valve, the first throttle device, and the second throttle device are turned off, so that the compressor, the first heat exchanger, the third throttle device, and the third heat exchanger are connected in a refrigerant loop.

10. The heat pump system of claim 5, wherein:

the heat pump system is configured to implement a plurality of operating modes, and the plurality of operating modes comprises a cooling and hot water production mode, and when the heat pump system is in the cooling and hot water production mode, the six-way valve is maintained in the third state, the first control valve and the second throttle device are turned on, and the second control valve, the third control valve, the first throttle device, and the third throttle device are turned off, so that the compressor, the first heat exchanger, the second throttle device, and the second heat exchanger are connected in a refrigerant loop.

11. The heat pump system of claim 5, wherein:

the heat pump system is configured to implement a plurality of operating modes, and the plurality of operating modes comprises a hot water production and defrosting mode, and when the heat pump system is in the hot water production and defrosting mode, the six-way valve is maintained in the first state, the third control valve and the first throttle device are turned on, and the first control valve, the second control valve, the second throttle device, and the third throttle device are turned off, so that the compressor, the third heat exchanger, the first throttle device, and the first heat exchanger are connected in a refrigerant loop.

* * * * *